US012337942B2

(12) United States Patent
Angelini

(10) Patent No.: US 12,337,942 B2
(45) Date of Patent: Jun. 24, 2025

(54) FIRST STAGE PRESSURE REGULATOR WITH THRESHOLD ACTUATION

(71) Applicant: Mares S.p.A., Rapallo (IT)

(72) Inventor: Sergio Angelini, Lavagna (IT)

( * ) Notice: Subject to any disclaimer, the term of this patent is extended or adjusted under 35 U.S.C. 154(b) by 1100 days.

(21) Appl. No.: 17/236,615

(22) Filed: Apr. 21, 2021

(65) Prior Publication Data

US 2021/0331773 A1 Oct. 28, 2021

(30) Foreign Application Priority Data

Apr. 24, 2020 (IT) ..... 102020000008914

(51) Int. Cl.
*B63C 11/22* (2006.01)

(52) U.S. Cl.
CPC ... *B63C 11/2209* (2013.01); *B63C 2011/2218* (2013.01)

(58) Field of Classification Search
CPC ... B63C 11/2209; B63C 11/22; B63C 11/018; B63C 11/02; B63C 2011/2254; B63C 2011/2218; G05D 16/107; G05D 16/109; A62B 7/00; A62B 7/02; A62B 9/02; A62B 9/022; Y10T 137/2036; Y10T 137/1842; Y10T 137/1939; Y10T 137/2012
USPC ..... 251/77, 63.4; 137/81.2, 505.12
See application file for complete search history.

(56) References Cited

U.S. PATENT DOCUMENTS 389,643 A * 9/1888 Dixon ..... B60T 15/42 251/63.4
3,211,175 A * 10/1965 Replogle ..... G05D 16/10 137/71
3,307,597 A * 3/1967 Shugarman ..... A62B 9/02 137/493
3,719,160 A * 3/1973 Christianson ..... B63C 11/2209 73/702
3,865,132 A * 2/1975 Wiegand ..... F16K 17/105 251/63.4
3,898,403 A * 8/1975 Grayson ..... H01H 36/00 251/63.4
4,192,298 A * 3/1980 Ferraro ..... G05D 16/103 137/484.4
4,230,140 A * 10/1980 Hart ..... B63C 11/2209 137/81.2

(Continued)

*Primary Examiner* — Colin W Stuart
(74) *Attorney, Agent, or Firm* — Themis Law

(57) ABSTRACT

A first reducing stage of two-stage regulators includes a first chamber that receives a high pressure breathable gas, a second chamber for the breathable gas at an intermediate pressure, and a pressure reducing valve that connects the first and the second chamber. The valve includes a valve seat with an opening for communication between the first and the second chamber, and a plug cooperating with the valve seat and movable between closed and open positions and vice versa. The plug, dynamically connected to a sensor exposed to the outer pressure, includes a transmission mechanism of the mechanical stress due to the outer pressure on the plug, which has a member that stops and starts the kinematic transmission chain according to the mechanical stress due to the outer pressure. Such member includes mechanical stress sensors that stop the kinematic transmission chain when the mechanical stress is below a predetermined threshold value and that restart the kinematic transmission chain when the mechanical stress is equal or above the threshold value.

19 Claims, 5 Drawing Sheets

(56) References Cited

U.S. PATENT DOCUMENTS

| | | | | | |
|---|---|---|---|---|---|
| 4,287,812 | A * | 9/1981 | Iizumi | F15B 13/01 | 251/63.4 |
| 4,396,032 | A * | 8/1983 | Duchesne | B63C 11/2209 | 137/71 |
| 5,097,860 | A * | 3/1992 | Ferguson | G05D 16/0402 | 128/204.29 |
| 5,184,609 | A * | 2/1993 | Hart | B63C 11/2209 | 128/205.24 |
| 5,379,761 | A * | 1/1995 | Schuler | G05D 16/0402 | 128/205.24 |
| 5,810,041 | A * | 9/1998 | Garofalo | G05D 16/0663 | 251/356 |
| 5,911,220 | A * | 6/1999 | Morgan | B63C 11/2209 | 128/205.24 |
| 2004/0011361 | A1* | 1/2004 | Clarke | B63C 11/2209 | 128/201.27 |
| 2015/0205306 | A1* | 7/2015 | Schmitz | F16K 31/1221 | 137/505.41 |
| 2016/0041563 | A1* | 2/2016 | Cigolini | B63C 11/2227 | 137/486 |
| 2018/0319472 | A1* | 11/2018 | Angelini | B63C 11/2209 | |

* cited by examiner

FIRST STAGE PRESSURE REGULATOR WITH THRESHOLD ACTUATION

FIELD OF THE INVENTION

The present invention relates to a pressure control device, in particular it relates to the first reducing stage of a two-stage regulator assembly for scuba diving use.

BACKGROUND OF THE INVENTION

Two-stage pressure control and air regulator devices are known, e.g. for scuba diving use, wherein the first pressure control stage is connected to a breathable high-pressure gas source, such as a tank usually loaded at 200-300 bar, and it is suitable to control said pressure to a preset intermediate pressure. The breathable gas at such intermediate pressure is then conveyed, by means of special ducts, to a second stage configured for further pressure reducing to a value compatible with the respiratory system of the scuba diver user (ambient pressure).

A family of known pressure reducers are the so-called compensated reducers, designed to balance the effect of the additional pressure that the external environment exerts on the device, effectively making the intermediate pressure higher than the ambient pressure by an almost constant value even in response to the water depth variation.

There are now different variations of compensated first stage types which are divided into two macro-types: one type uses a membrane to transfer the effect of the external pressure on the pressure reduction system while the other type uses a piston in place of the membrane. The membrane system uses a valve (shutter-seat system) distinct from the membrane itself, while in the case of the piston the piston itself represents not only the sensor member to ambient pressure but also the shutter.

SUMMARY OF THE INVENTION

The present invention is contextualized mainly in the macro typology of the first membrane stages, although the teaching can also be transferred by the skilled in the art to piston devices that have mechanically compatible embodiments.

A first membrane pressure reduction stage comprises a body provided with an inlet connected to a source of breathable gas at high pressure and an outlet for the breathable gas at reduced pressure with respect to the pressure of the incoming gas, said body being divided in at least one chamber for the high-pressure gas, communicating with said inlet, and a chamber for the intermediate-pressure gas, connected with said outlet, and the chamber for the intermediate-pressure gas being communicating with the chamber for the high-pressure gas pressure via a pressure reducing valve.

Said pressure reduction valve comprises a valve seat which separates the high-pressure chamber from the intermediate pressure chamber which cooperates with a shutter, with an enlarged head connected to a stem, so-called piston shutter.

Said shutter is housed inside the high-pressure chamber and can be axially displaced, that is in a direction parallel to its longitudinal axis, alternatively in both directions, inside the said high-pressure chamber, so that the enlarged head alternately performs a stroke in the direction of detachment from and away from the valve seat and a stroke in the direction of approach and contact against said valve seat.

A rod is connected with an elastically deformable membrane, which membrane is in contact with water and consequently exposed to the pressure of the external environment and on which an elastic preload further operates. The elastic preload defines, after appropriate calibration, the value of the intermediate pressure in addition to the ambient pressure. If on the sea surface the elastic preload is calibrated so as to have an intermediate pressure of 10 bar, once the diver drops to for example 20 meters, the intermediate pressure will rise to 12 bar since for every 10 meters of depth there is an increase of the ambient pressure equal to 1 bar. This intermediate pressure compensation as the depth varies, such that there is always a constant value (10 bar in the example) in addition to the ambient pressure, is very important for the regular operation of the regulator and is guaranteed by the presence of the membrane, in such a way that the pressure of the external environment and the elastic preload cause an inflection of the membrane itself in the direction of opening of the dispensing valve upon inspiration, which inflection is transmitted to the shutter by said rod. The elastic preload is exerted by a spring, whose compression is adjustable by a metal nut (usually chromed brass but can be in stainless steel, titanium or other) held inside a so-called membrane locking nut, also usually of chromed brass (but it can be stainless steel, titanium or other) which, as the name suggests, also has the role of fixing the membrane on the intermediate pressure chamber. The spring, the membrane locking nut and the adjustment nut, being all above the membrane, are submerged into the water.

In its simplest configuration, the shutter is pushed in the closing direction by an elastic preload present in the high-pressure chamber which acts in the opposite direction with respect to the elastic preload acting on the membrane, which preload acting on the membrane in combination with the ambient pressure acting on the membrane is overcome by the combination of elastic preload in the high pressure chamber and intermediate pressure operating on the membrane until the shutter reaches the closed position, a situation where the elastic preload present in the high pressure chamber does not effect in the balance of forces.

When the intermediate pressure is lower than a certain threshold, the sum of the forces operating in the opening direction of the valve prevail over those operating in the opposite direction and the valve opens.

The sensor member to ambient pressure also works as a physical separator between the intermediate pressure chamber and the external environment (i.e. the diving water). This fact is appreciated for two reasons:

in the case of diving in contaminated waters, the total separation between the external environment and the breathable air absolutely avoids a possible infection;

in case of diving in very cold waters it considerably delays problems due to freezing of the water around the main element of the operation, that is the spring, since the expansion of the gas takes place in a zone separated from the water by the membrane. The membrane operates as a thermal insulator so that the cooling generated by the operation of the first stage due to the expansion of the breathable gas for the transition from high pressure to intermediate pressure can be successfully dispersed on areas distant from the spring. This reduces the danger of ice forming between the coils of the spring which would lead to the blocking of the spring itself.

Despite the many benefits, this known configuration can avoid but only partially the danger of freezing due to the presence of water in contact with the spring and also has the drawback deriving from the possibility, even if remote, of the introduction of foreign matter in the chamber housing the membrane, such foreign matter could hinder the normal functioning of the spring by placing themselves between the coils thereof, thus preventing the regular supply of breathable gas to the intermediate pressure chamber according to the demand generated by the user breathing cycle. This problem is also present in piston embodiments.

According to a known alternative solution, to overcome this kind of problem, an incompressible insulation fluid is used with a freezing point lower than that of water or air combined with a pressure transmission element that normally fills the membrane housing (FIG. 3). In the case of the incompressible fluid, this is held in an intermediate chamber which is bounded by a first membrane towards the external environment and by a second membrane towards the intermediate pressure chamber. These two membranes therefore generate a chamber for separating the external environment from the intermediate pressure chamber, whose pressure is the ambient pressure transmitted through the membrane facing the environment to the fluid placed in the intermediate chamber, which transmits it to the membrane facing the intermediate pressure chamber (main membrane). This solution therefore allows the pressure difference across the two sides of the main membrane to be kept constant equal to the intermediate pressure.

In the case where the isolation fluid is air, the transfer of the force exerted by the external environment on the aforementioned first membrane to the second membrane and therefore to the shutter can take place through one or more movable elements with greater rigidity equipped with a surface relatively wide cooperating with said membranes (for example a piston pushing on a plate). However, in this case in the chamber interposed between the two membranes the pressure remains constant at the atmospheric value during production, so that the pressure difference across the main membrane is equal to the sum of ambient pressure plus intermediate pressure on the surface, with the consequent risk of tearing it.

The risk of tearing the membranes in the case of air and a rigid element and the increased maintenance complexity in case of incompressible fluid, especially in the presence of oily fluids, does not fully satisfy the needs. In the category of the first stages of pressure regulation with shutter and seat there is a variant of the aforementioned art in which the sensor member includes one or even two pistons operating in place of the aforementioned membranes. An Applicant's application with double piston sensor, identified with the term TWIN BALANCED PISTON, defines in fact a third macro-type and is the subject matter of Italian Patent Application N° 102018000006613.

A first stage of this type differs from what has been described above in relation to the case of piston first stages since in this case the piston does not act as a shutter (as instead occurs in the piston first stages) but only as an ambient pressure sensor member. It therefore falls into the category of membrane first stages, with the only difference that the bending flexible membrane is replaced by a translating rigid piston.

Regardless of the technology used to the pressure control, whether with a membrane-controlled shutter, piston or piston-controlled shutter, a first regulator stage operates by performing, as mentioned, a pressure reduction of the breathing gas contained in one or more tanks, bringing the gas to an intermediate pressure compatible with the operation of a second reducer stage, downstream of which air at ambient pressure is supplied to the user diver.

To ensure the performance of the second stage regulator to the diver, the diver must receive air pressure exceeding at the ambient pressure of an almost constant value and therefore that increases by about 1 bar for every 10 m of depth increase. This therefore involves an intermediate pressure delivered by the first stage which, starting from about 10 bar on the surface, increases linearly with the depth as shown with the curve 510 in FIG. 5 or 610 in FIG. 6.

However, there are applications in which it is advantageous to have a constant intermediate pressure independent of depth. For example, in a closed-circuit system, the so-called rebreather, the concept of sonic flow can be exploited to obtain a constant supply of oxygen to replace the basal oxygen metabolized by the diver. Exploiting the concept that for the flow of a gas through an orifice, the quantity of gas flowing is constant and depends only on the section of the orifice and on the pressure value upstream of the orifice as long as the ratio of pressures across the orifice has a minimum value (equal to about 2 for air), it is possible to pass a constant quantity (mass) of oxygen to support what is metabolized by the diver (which is independent of depth) and therefore provide for an oxygen regulation only to compensate for any efforts that cause the diver to consume more oxygen (for example, having to deal with a current). Clearly, as the depth increases, the pressure downstream of the orifice increases (being equal to the ambient pressure) so that at a certain point it is no longer possible to guarantee the sufficient supply of oxygen since the pressure ratio across the orifice itself falls below at the threshold that guarantees the sonic flow or even reverses if the ambient pressure exceeds the pressure value upstream of the orifice.

It is therefore desirable to have a first stage that can guarantee a constant intermediate pressure up to a certain depth, so as to be able to exploit this constant supply of oxygen, after which it is made to increase proportionally to the depth in order to guarantee a flow of oxygen to depths greater than the limit value.

In the example case, FIG. 5 shows the delivery behavior of a first stage in the known art 510 and the desired behavior for the target operation 520.

The object of the present invention is therefore to provide a first reducing stage for two-stage dispensing units which is able, by means of a constructively simple and efficient solution, to overcome the problems illustrated above, ensuring delivery at constant pressure up to a certain depth and which then presents a linear (proportional) trend as the pressure increases imposed by the external environment. This linear increase can be equal to, greater or less than the increase in ambient pressure, as described below.

The object of the present invention is therefore a first reduction stage for two-stage dispensing units, comprising:

- a first chamber for a high-pressure breathable gas, which chamber is connected or connectable with an inlet to a source for a high pressure gas;
- a second chamber for the breathable gas at an intermediate pressure, which chamber for the intermediate pressure gas has an outlet for the intermediate pressure gas and is connected or connectable to a user of said intermediate pressure gas;
- a pressure reducing valve which connects said first chamber and said second chamber together and which valve comprises a valve seat with a communication opening between said first and said second chamber and a shutter cooperating with the said valve seat can be displaced from a closed position of said passage opening to an open position of said passage opening and vice versa, said shutter being connected to a sensor member exposed to the pressure of the external environment with respect to said two chambers, which sensor member is provided in combination with a transmission mechanism transmitting to the shutter itself the mechanical stress exerted on said sensor member by the pressure of the external environment, mechanical transmission which is depending on the mechanical stress exerted on first interface by the pressure of the external environment, said suspension/reactivation member being provided with sensors for the mechanical stress suspending the Kinematic transmission chain when the mechanical stress is below a predetermined threshold value and restoring the kinematic chain of transmission when said mechanical stress is equal to or exceeds the said threshold value.

According to an embodiment, the transmission mechanism has two elements movable relatively between each other between said sensing member of the mechanical load applied by the environment pressure and said shutter, said elements being connected by a joint coupling actuated by a sensor of the mechanical load of the external environment pressure and that dynamically connects the two elements together when said mechanical loads exceeds a certain threshold value, while it is idle when the mechanical load is below said threshold.

In one embodiment, the said two elements are constituted by cursors relatively moving between two stop positions, one of maximum mutual spacing and one of reciprocal abutment of the said strikers, and in such reciprocal contact position the two elements move integrally along the further stroke in a direction parallel to the direction of the reciprocal approach stroke, elastic means of variable force being provided that are interposed between said two elements and opposing to the movement in the approach direction of the said two elements from the position of maximum distancing to the position of mutual contact of the said end of stroke limiters, so that the said two elements reach condition of reciprocal abutment of corresponding strikes only when the opposing force of said elastic means is exceeded.

According to an embodiment of the present invention which reproduces the general concept set out above, the said sensor members for the pressure of the external environment two movable wall elements, that are spaced apart thanks to means of reciprocal connection parallel to the relative sliding direction and which are hermetically sliding in a housing chamber, one of said the movable wall element constituting the interface with the external environment and the other of said elements constituting the interface with the intermediate pressure chamber also defining and sealing an interposition chamber towards the external environment and towards the intermediate pressure chamber respectively, which intermediate pressure chamber is isolated from the external environment and from the intermediate pressure chamber, said interposition chamber being made up of a segment of the housing chamber having a variable position and whose extension in the direction of sliding of the two wall elements movable is essentially corresponding to the distance of said two movable wall elements to each other, wherein said mutual connecting means between said two said movable wall elements introduce at least one degree of freedom between said two said movable wall elements with respect to their relative positions, said mutual connecting means presenting:

a spatially limited free-running state in which the force of the outdoor environment is not transferred to said movable wall element;

a reciprocal rigid coupling state in which at least part of the force that the external environment exerts on said external movable wall element is transferred to the movable wall element interfacing with the intermediate pressure chamber only upon exceeding a predetermined level of force exerted by the external environment;

said reciprocal connection means comprising at least one or a combination of elastic preloading members acting on the mobile wall member interfacing with the external environment and exerting an action in contrast with the force that the external environment exerts on said movable wall element.

Therefore, as shown above, the invention manages to solve the technical problem by decoupling the two movable wall elements of the first stage and then adding a controlled release characteristic between the force that the external environment brings to the sensor member and the force that the sensor member transfers to the shutter valve. In this way, the desired result of constant intermediate pressure is obtained up to a certain depth, after which there is an increase proportional to the further increase in depth.

The component of elastic elements able to control the effects of the forces deriving from the gas under pressure and the external environment enters the set of forces that regulate the overall operation of the device, as is already well known in the state of the art. The innovative component of the invention involves an additional action contrary to the force of the external environment, substantially invariable as the depth conditions vary, and such as to interrupt the mechanical chain of transmission of the force of the ambient pressure to the shutter and in this case of the executive example of application of keeping the two movable wall elements released up to a predetermined depth beyond which these two elements find themselves in a condition of reciprocal rigid coupling and operate to control the shutter which regulates the intermediate pressure.

In a preferred embodiment, said at least one or a combination of elastic preloading members comprise a mechanical element such as for example a coil spring, while other forms may contemplate different mechanisms for the controlled generation of elastic forces: think for example to a further sealed chamber filled with gas or in general with a compressible fluid, being part of the wall of said mobile chamber and subjected to ambient pressure which acts by reducing its volume as the depth increases until a corresponding minimum position is reached to the position of said reciprocal rigid coupling state between the movable wall elements as described above.

Further embodiments may include combinations of mechanical and non-mechanical members, freely selected by the person skilled in the art in order to obtain the greatest benefits in carrying out the teaching of the present invention.

Thus, embodiments may be provided in which an elastic pre-loading element is also associated with the mobile wall member interfacing with the intermediate pressure chamber, said pre-loading element being advantageously positioned inside the delimited interposition chamber by said two movable wall elements.

Other advantageous non-exclusive embodiments that can be combined with the previous ones can comprise a stationary stop, located inside the housing chamber and interposed between the two movable wall members, said stop preferably and optionally in the form of an adjustable ring nut, said stop provided with a suitable surface operating as a stop for said preloading elements.

Further embodiments provide that one or more elements of the device, such as the high pressure chamber, the intermediate pressure chamber, the housing chamber, the seat of the pressure reducing valve and/or the passage opening in said seat, the piston shutter and its guide seat, the movable walls of the sensor member, the connecting rod between said sensor member and piston shutter have rotational symmetry and are coaxial with each other.

The invention may benefit from measures already known to cancel or in any case reduce the formation of ice that hinders the functioning of the moving parts and therefore of the device even with lethal consequences for the diver. These measures include the use of non-metallic materials with limited heat transfer in the gas expansion areas. Advantageously, one or more elements forming the said housing chamber (102) and/or of the said sensor member for the pressure of the external environment are made of a material or a combination of materials having a thermal conductivity lower than the thermal conductivity of the metallic materials, at the same time said a material or combination of materials having mechanical features such as not to compromise the correct functioning of the assembly.

BRIEF DESCRIPTION OF THE DRAWINGS

Further advantages and features of the device according to the present invention will become evident from the following description of an embodiment thereof, carried out for purposes of non-limiting example, with reference to the tables of the attached drawings, in which.

DETAILED DESCRIPTION OF EMBODIMENTS OF THE INVENTION

Figure 1:
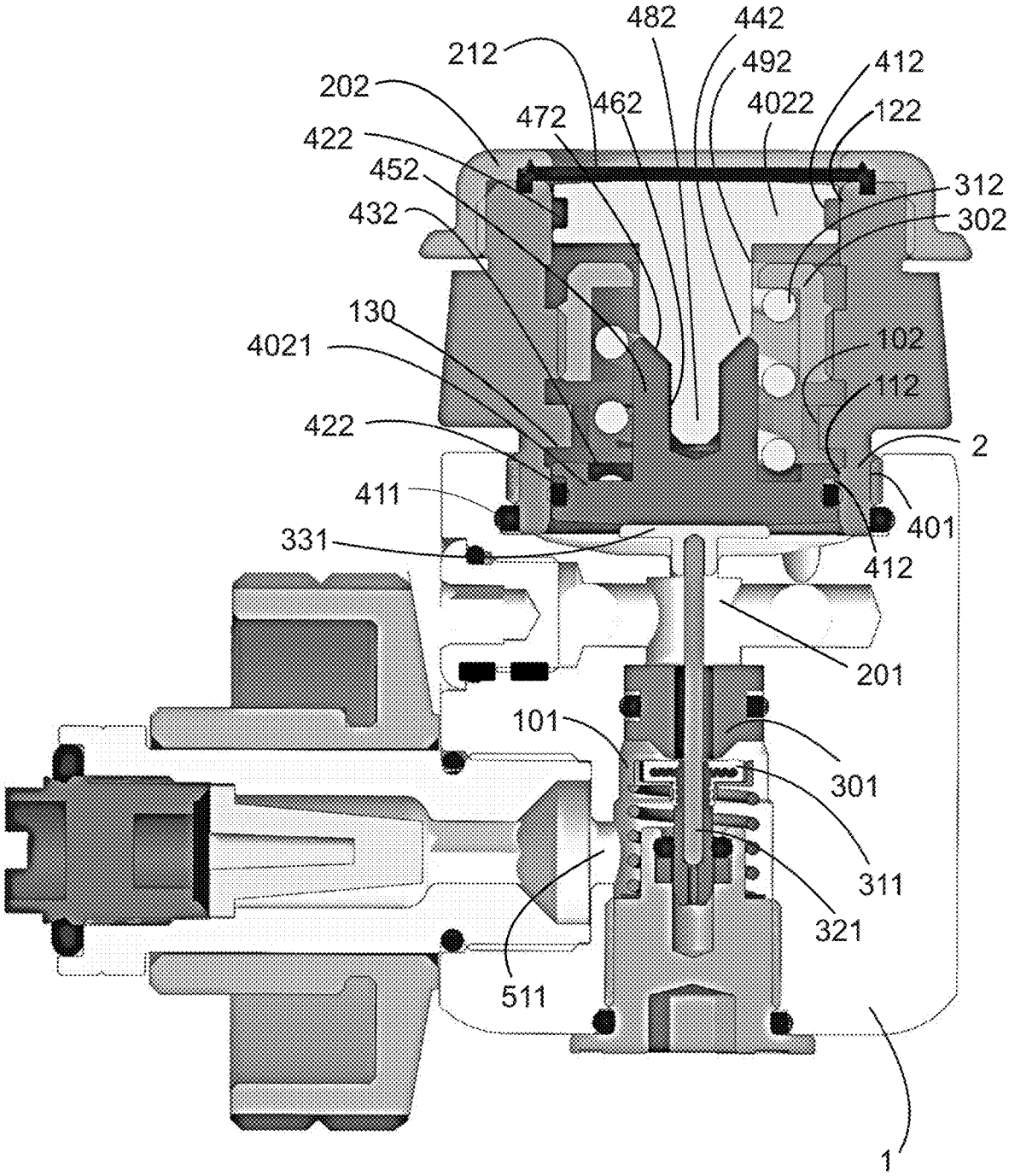
Fig. 1 (Prior Art)
FIG. 1 shows a cross-sectional view according to a plane passing through the axis of symmetry parallel to the direction of movement of the shutter of the pressure reducing valve and which view relates to an embodiment of the known art which uses two pistons as movable wall elements.

In FIG. 1, is designates with the reference number 1 the body of said first stage, which has a high-pressure chamber 101, equipped with a plurality of high-pressure outlets, for example for connecting pressure gauges or other utilities, and is connected in a way not shown in the figure and known per se to a high pressure breathing gas supply cylinder. The seat 301 of the reduction valve is located in the chamber, which opens into the intermediate pressure chamber 201, and whose flow is regulated by the obturator 311. Also in this embodiment the obturator is coupled to the rod 321, which ends at the opposite end, inside the chamber 201, with a plate 331. The intermediate pressure chamber is provided with a plurality of outlets towards the intermediate pressure gas ducts.

At the top of the intermediate pressure chamber 201, a threaded opening 401 is formed in the body 1 of the first stage, in which the block 2 is screwed tightly thanks to the gasket 411. Inside the block 2 a cylindrical chamber 102 is formed for housing a pressure sensor member of the external environment The said chamber 102 is provided with two ground cylindrical seats 112 and 122, respectively facing the intermediate pressure chamber 201 and the external environment and separated by a threaded section in which a stop ring 302 is screwed for a coil spring 312 for elastic preload of the sensor member of the pressure of the external environment.

Two movable wall elements 4021 and 4022 are inserted into both seats 112, 122 respectively as a piston. The two movable wall elements illustrated in FIG. 1 are identical to each other particularly with respect to the surface of the two faces perpendicular to the direction of translation or to the central axis of the same.

This configuration is not intended to be limiting but is only a choice between possible variants in which said movable walls 4021 and 4022 can have different diameters: once the threshold value has been exceeded, if the diameters are the same, the intermediate pressure increase will be equal to the increase in ambient pressure, if the diameter of the upper mobile wall 4022 is smaller than the diameter of the mobile wall 4021 this increase, even if linear, will be less than the increase in ambient pressure, while if the diameter of the upper mobile wall 4022 is greater of the diameter of the mobile wall 4021 this increase, albeit linear, will be greater than the increase in ambient pressure.

The two movable wall elements 4021 and 4022, i.e. the two pistons, can be displaced together and are coupled together presenting on the opposite faces, respectively, the movable wall element 4022 which constitutes the separation wall towards the external environment a coupling stem 482, and the second movable wall element 4021 which interfaces with the intermediate pressure chamber 201 a coupling seat of said stem in the form of a bushing 452 axially coinciding with said stem 482, in particular coaxial to the same.

A preferred embodiment may further provide that the stem has a base segment 492 with which it is connected to the corresponding movable wall element 4022. This base segment has a diameter greater than a coaxial, terminal segment which is intended to engage in a hole 462 of the coupling seat 452 and to be locked therein. The axial length of the hole 462 is commensurate with the axial length of the said terminal segment of the stem 482.

According to a further possible feature, and as also illustrated, the coupling seat 452 is in the form of a cylindrical bushing and has an external diameter corresponding to the external diameter of the said base 492 of the stem 482. The coaxial hole 462 has a diameter corresponding to that of the terminal segment of the stem 482.

The base 492 of the stem 482 is connected with a conically tapered portion 442 to the terminal segment, while the seat 452 has an inlet portion 472 which tapers conically from the insertion end towards the bottom of the hole 462, starting from external diameter of the bush which forms said coupling seat 452 towards the internal diameter of the same and with an opening angle corresponding to that of the tapered portion 442 of the stem 482.

The coupling seat 452 in the form of a bushing is associated with the wall element 4021, or with the piston interfacing with the intermediate pressure chamber 201 and constitutes a central support element of the elastic element 312, for example of a coil spring.

The rigid, integral connection of the two movable wall elements 4021 and 4022, or of the two pistons, can take place thanks to removable and/or separable mechanical coupling means which allows the two pistons i.e., the two movable wall elements, to be separated from each other.

In relation to the rigid connection of the two movable wall elements it is possible to provide other alternative solutions. According to a variant embodiment, the two piston-like movable wall elements 4021 and 4022 are rigidly coupled to each other by means of a pin screwed with the two ends respectively in a threaded cup formed coaxially to the same in the faces facing each other of the other of the two movable wall elements 4021 and 4022.

The pistons 4021 and 4022, of substantially cylindrical shape, have a toroidal groove 412 formed on the lateral surface, in which a sealing element 422 is housed. On one face of the movable wall 4021 interfacing with the intermediate pressure chamber 201 an annular groove 432 is formed which surrounds the coupling seat 452. The end of a preload spring 312 is inserted into said annular groove, the opposite end of which abuts against the stop ring nut 302 which is screwed to the block 2 inside the chamber 102 in an intermediate position between the rectified cylindrical portions 112 and 122.

Due to this embodiment, an intermediate insulation chamber is generated in the cylindrical chamber 102 of block 2 and between the intermediate pressure chamber and the external environment, which remains sealed both towards the intermediate pressure chamber and towards the external environment. This isolation chamber translates correspondingly to the translation together of the two pistons 4021 and 4022 rigidly connected to each other. The translation of said pistons is delimited in both directions by annular, radial internal shoulders which define the translation limit switches, one of which in the outward direction is constituted by the shoulder 130 cooperating with the piston 4021 interfacing with the intermediate pressure chamber 201, while the other in the direction towards said intermediate pressure chamber consists of a stop of the shutter in the high pressure chamber and/or of the head side of the cylindrical chamber 102 cooperating with the plate 331.

It is clear that this ring nut 302 and said coil spring 312 always remain inside the isolation chamber and therefore separated from the external environment and from that of the intermediate pressure chamber. Different fluids can be used as fluid, but ambient air at atmospheric pressure is preferred, which is generated automatically in the assembly phase in the factory.

However, this does not mean that different types of fluids or mixtures thereof and different pressure conditions can be provided in the said isolation chamber and that the said isolation chamber is possibly accessible through an inlet which is provided with closing means. removable type seal.

It is possible that the intermediate insulation chamber between the two movable wall elements is filled with argon or an argon-containing gas mixture since this inert gas has excellent thermal insulation qualities, improving safety against the formation of ice on the wall of the "upper piston" facing the environment.

The coil spring and the area in which it is housed remain free from the dangers of ice formation and also from the dangers of infiltration of impurities, dirt or other that could mechanically limit or completely prevent the operation of the spring.

According to a further feature, which is entirely optional and could also be omitted, at the end of the block 2 in which the seat 122 is formed, a flexible membrane 212 is arranged by means of a threaded ring nut 202, which adheres to the face of the movable wall element 4022 facing the external environment and interfacing with it. The pressure of the external environment acts on the mobile wall element 4022 through said membrane 212 which deforms under the action of said pressure and the membrane has the sole and sole purpose of isolating the chamber 102 only from the point of view of fluid circulation which can generate effects of wear or degradation of the sealing gaskets of the movable wall 4022 against the wall of the cylindrical chamber 122 in which it is housed both from the chemical point of view and due to the transport of material granules.

The embodiment illustrated in FIG. 1 therefore represents a solution that isolates the compensation chamber 102 from the external environment, and the membrane 212, leaning directly on the movable wall element, actually transmits the pressure variations of the external environment to the piston 4022, while avoiding direct contact of the fluid of the external environment with the piston 4022 and the seals, protecting them. Advantageously, especially from the manufacturing point of view, with regard to the illustrated embodiments, the movable wall element 4021 interfacing with the intermediate pressure chamber can be identical for both embodiments, making it only necessary to provide the other movable wall element to realize the embodiment of FIG. 1.1.

The piston inserted in the seat facing the intermediate pressure chamber is elastically preloaded thanks to the spring 312, as was the case for the membrane used in the state of the art. The rigid connection between the two pistons 4021 and 4022 guarantees the action of the two movable walls in fact like that of a monolithic entity, which transfers the pressure variations detected in the external environment directly to the rod 321 which operates on the shutter of the reducing valve.

A variant embodiment of the embodiment according to FIG. 1 can provide that the movable wall element, i.e. the piston 4022 which constitutes the interface with respect to the external environment and which is in contact with the membrane 212, slides freely and does not seal in the cylindrical section 122 and that the seal towards the external environment of the intermediate insulation chamber delimited by the two mobile wall elements 4022 is entrusted to the side facing the external environment only by the membrane 212. This reduces sliding friction and in any case the upper membrane is the least stressed since it only senses the pressure difference between the surface and the environment.

Figure 2:
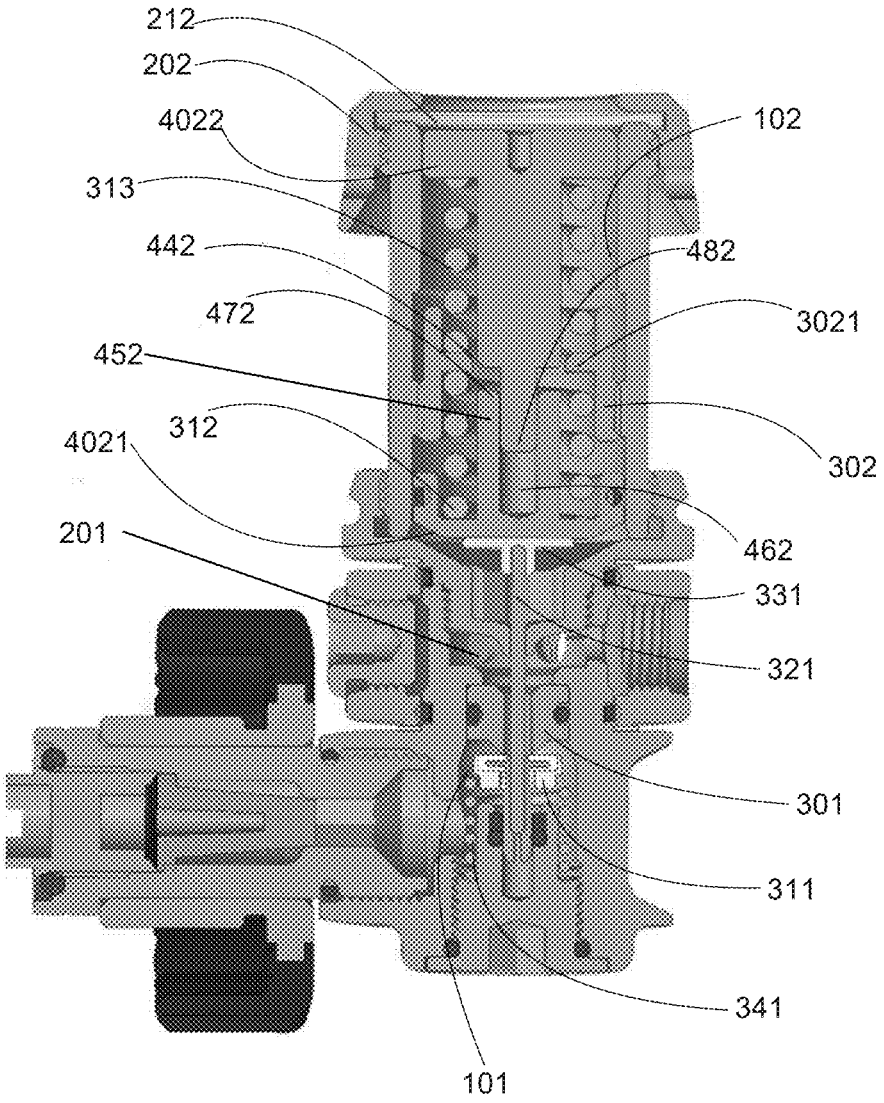
FIG. 2 shows a view similar to the previous one of first embodiment of the invention which defines an improvement of the first embodiment according to the known art illustrated in FIG. 1.

FIG. 2 shows an embodiment according to the present invention. In this embodiment, a possible realization of the inventive step is contextualized which is translated into the modification of the known art of FIG. 1 with the aim of obtaining the benefits and overcoming the technical problem, already described in detail, of delivering gas with a constant pressure up to at a preset depth and subsequently, i.e. as the depth further increases, the pressure in the intermediate chamber increases according to a trend directly proportional to the depth itself.

In this figure the numerical references of FIG. 1 are reused for the parts present in both figures and performing the same function, possibly unless particular conformations that do not affect the general economy of the system presented.

FIG. 2 therefore shows a first delivery stage operating by means of a valve comprising shutter 311 and seat 301, where the transfer of the force exerted by the external environment to the shutter involves elements of sealed movable wall 4021 and 4022 through the plate 331 which is in cooperation with rod 321.

As in the previous figure, the shutter 311 is in the closed position when it abuts the valve seat 301; in this condition, the high pressure gas cannot flow towards the intermediate pressure chamber 201 and therefore towards the outlets to which the ducts are connected to the second stage and therefore towards the user.

The opening of the valve, understood as the condition other than closing and in which more or less breathable gas can pass towards the chamber 201, is guided by the force resulting from the forces resulting from the high pressure in the chamber 101, to the pre-charge of the shutter 341, to the pressure of the intermediate chamber 201 and to the force that the movable wall element 4021 transfers by contact with the plate 331 and the rod 321 to the shutter itself.

While in known devices this last force increases linearly with increasing depth, in the present invention a series of expedients are introduced to adapt the transfer function and make it such as to overcome the technical problems already described.

In this embodiment, which must be considered as an example and not as limiting as other embodiments can lend themselves to putting the same inventive concept into practice, the two movable wall elements 4022 and 4021, or the two pistons, have on the mutually opposite faces, respectively a coupling stem 482, and a coupling seat of said stem in the form of a bushing 452 axially coinciding with said stem 482, in particular coaxial thereto.

The two movable wall elements 4021 and 4022 are provided with a degree of freedom in the reciprocal movement, provided along the axis of the chamber 102 in turn parallel to the axis of the shutter 311, such that the distance between the two varies according to the operating conditions between a position of minimum stroke and a position of maximum stroke.

Furthermore, the ring nut 302, already acting as a stationary stop for the preloading element 312, is modified to act as a further base for a second coil spring 313 positioned coaxially to the spring 312 and exerting a force contrary to the force of the external environment.

In rest conditions, i.e. non-diving, the two elements are kept at a predefined distance as a consequence of the action that the two preloading elements 312 and 313 perform in opposite directions, the ring nut being a stationary reference interspersed with both.

In particular, the spring 313 counteracts the approach of the mobile element 4022 in the direction of the element 4021 with an elastic force proportional to the excursion of the element itself with respect to the initial position.

As the external pressure increases, the greater force resulting from the pressure on the head of the element 4022 will counteract the spring load by reducing the distance between 4021 and 4022.

Figure 5:
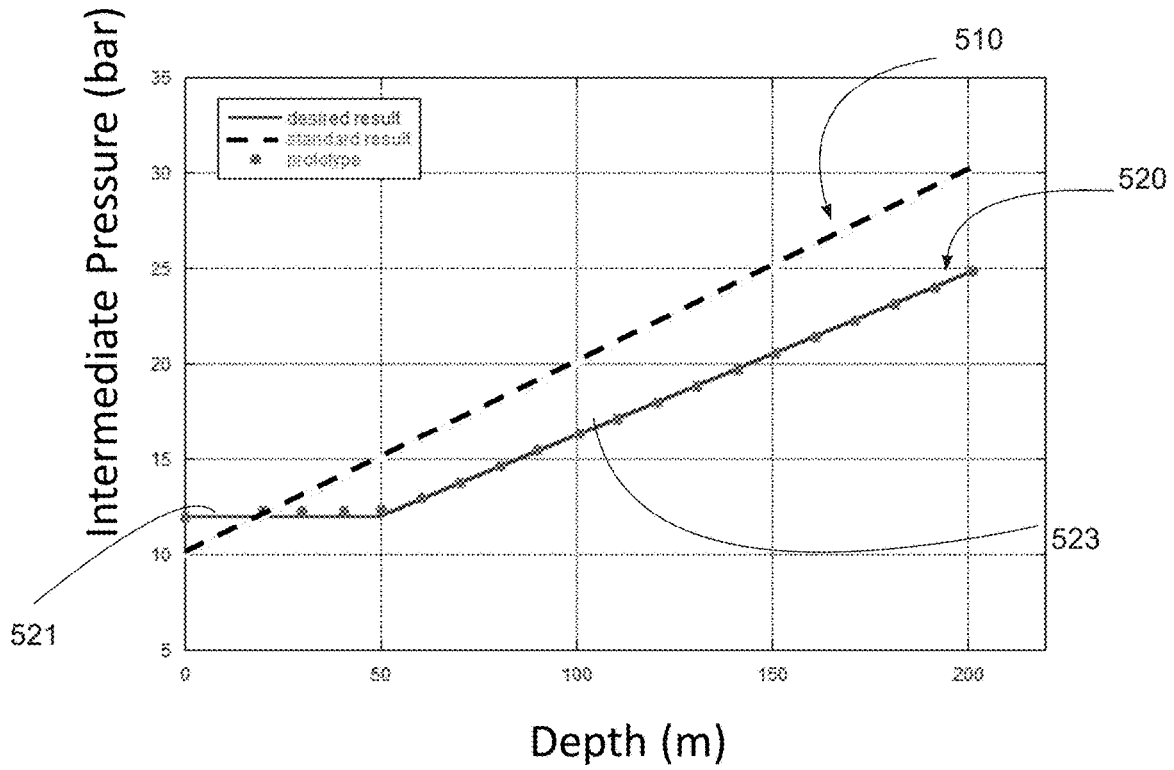
FIGS. 5 and 6 comprise two diagrams relating to the intermediate pressure trend according to the known art and according to the invention for two different applications.
Figure 6:
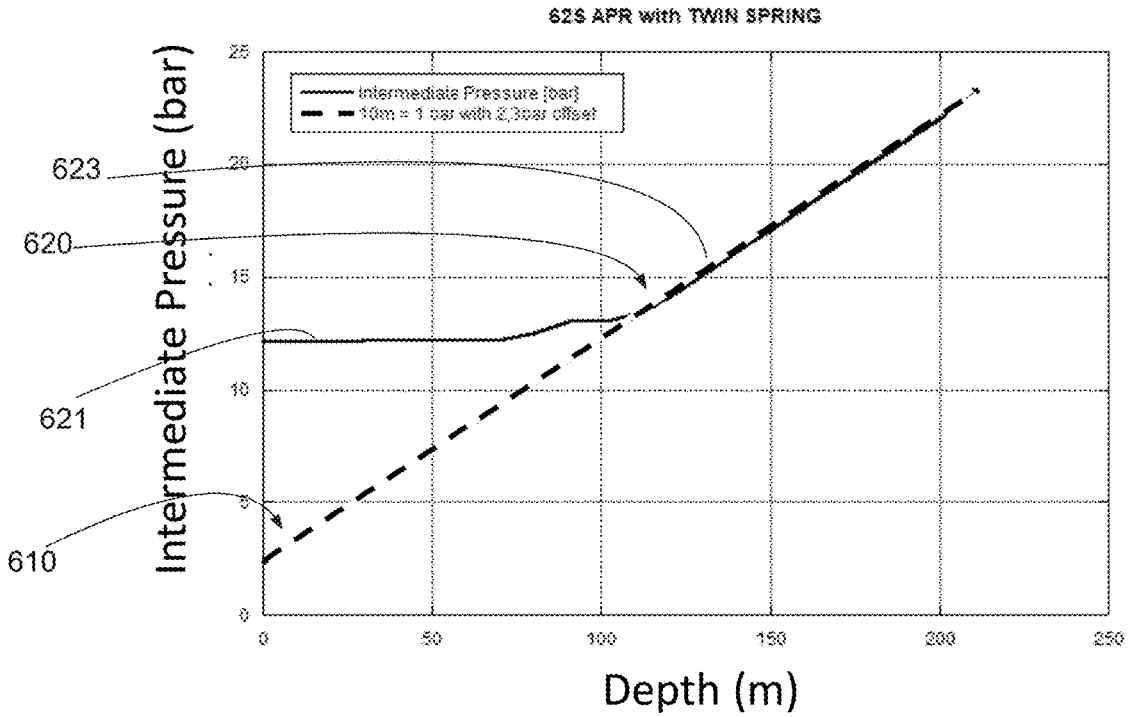

However, as long as a minimum value of this distance is not reached, the effect of the environment is substantially transferred to the ring nut 302 rather than to the shutter 311. The resulting behavior is of constant intermediate pressure of the breathable gas in the chamber 201, as shown in FIGS. 5 and 6, in particular in the plateau marked with the references 521 and 621. In reality, the gradual approach of the mobile element 4022 towards the mobile element 4021 causes a reduction in the internal volume and consequently a small pressure increase, which consequently leads to a small deviation of the intermediate pressure from a perfectly constant value. However, this variation is to all intents and purposes to be considered negligible.

When said minimum stroke position is reached, the two elements 4021 and 4022 are in mutual contact, the stem 482 is in the position of maximum penetration inside the seat 452 and, through contact between the respective opposite surfaces 442 and 472, the force exerted on the wall of the element 4022 by the environment is at least partially transmitted to the shutter in favor of its translation away from said closed position.

Under such conditions, the pressure regulation of the breathable gas is therefore comparable to that resulting from a first stage of the prior art: as the depth increases, the balance of the forces on the shutter changes, which therefore offers pressure in the intermediate chamber proportional to this depth in accordance with the increasing trend 523 and 623 of the respective FIGS. 5 and 6.

Figure 3:
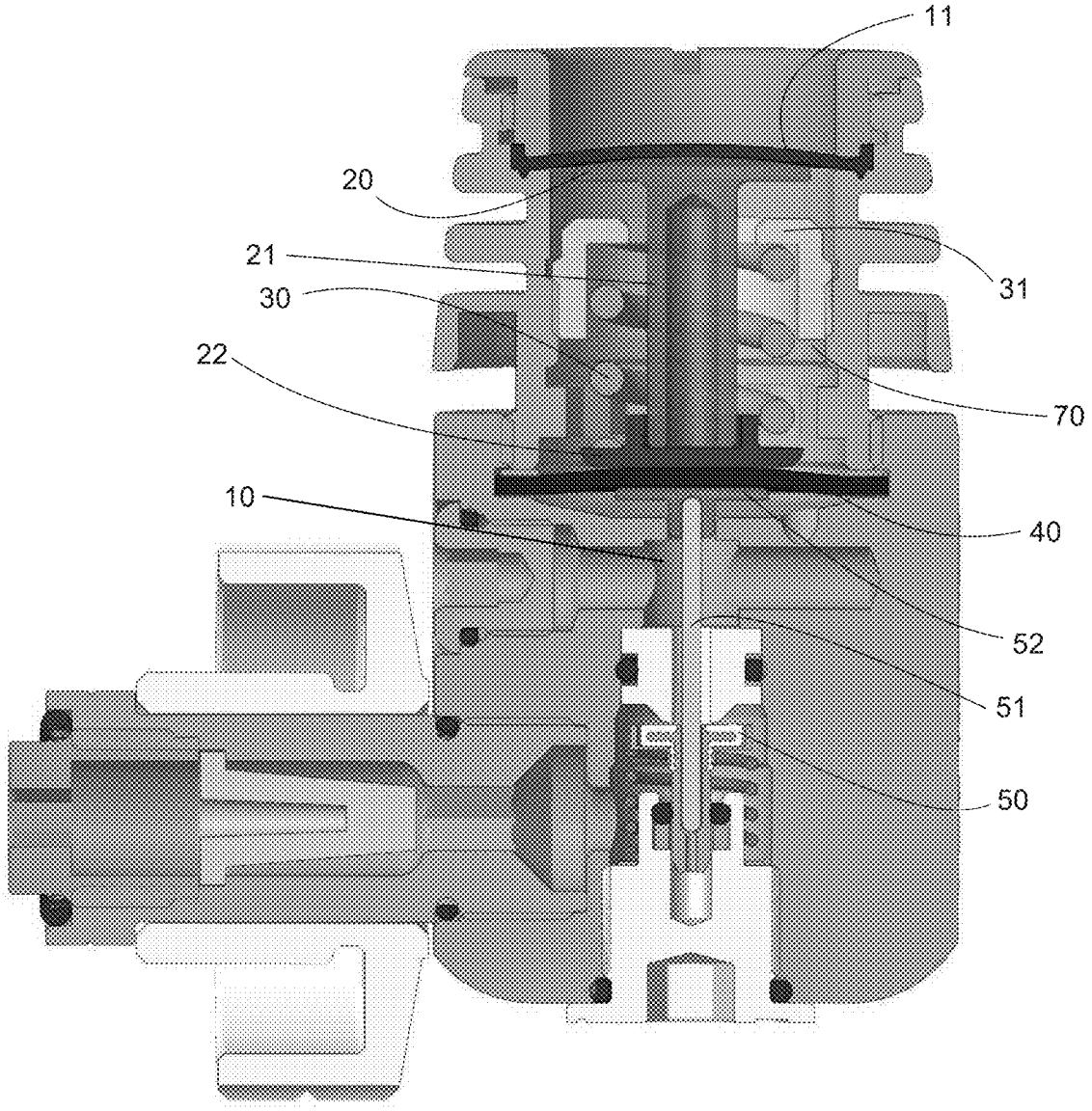
FIG. 3 shows a cross-sectional view according to a plane passing through the axis of symmetry parallel to the direction of movement of the shutter of the pressure reducing valve and which view relates to a different embodiment of the prior art which uses a pair of flexible membranes to define the interposition chamber between the intermediate chamber and the external environment.

FIG. 3 shows a configuration of the first dispensing stage of the membrane type, from which the difference with respect to the known art of FIG. 1 can be observed, whereby the elements that seal off the interposition chamber are two membranes rather than rigid elements.

In particular, this figure shows in section a first reducing stage of a two-stage dispensing unit according to the prior art in which an isolation chamber 70 is delimited towards the external environment by a first membrane 11 which is retained at held along its peripheral edge by the perimeter shell walls of said chamber 70. Towards the intermediate pressure chamber 10, the said isolation chamber 70 is separated from the intermediate pressure chamber by a second membrane 40, which is also held tightly along a perimeter band from the shell walls of the isolation chamber. A plate 20, to which a pin 21 is integrated, is connected to another plate 22, loaded by the spring 30 calibrated with the ring nut 31; the plate 22 insists on the membrane 40, which faces the intermediate pressure chamber and transfers the motion of the plate 22 to a plate 52 connected to the stem 51 of the dispensing valve 50. The membrane 11 isolates the chamber interposed between the plates 20 and 22 from the environment. In this way it is actually possible to isolate the chamber which houses the preload spring of the membrane 30 and the ring nut 31 for adjusting the preloading from the external environment, avoiding the drawbacks of the previous solutions of the prior art and at the same time allowing the variations to be detected. of pressure by means of the plates 20, 22 which communicate them to the membrane 40.

Figure 4:
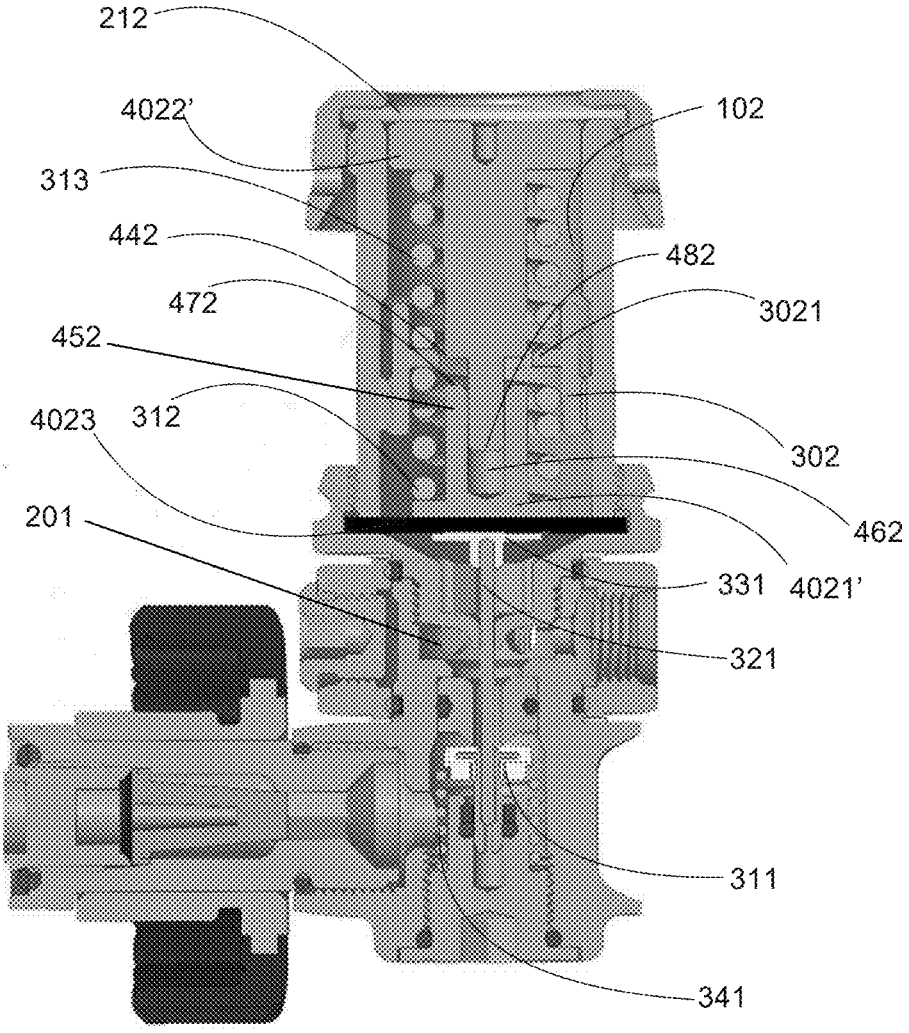
FIG. 4 shows a perspective view similar to the previous ones of a second embodiment of the invention which defines the improvement of the embodiment according to the known art illustrated in FIG. 3.

FIG. 4 shows a second embodiment of the invention which constitutes a possible improvement of the known art illustrated in FIG. 3, that is of a first regulator stage which uses a membrane to transfer the effect of the external pressure on the pressure reduction. The numerical references of the figure have been reused when consistent with the previous descriptions and it is possible to note how this second embodiment has a membrane 4023, whose operation is borrowed from the membrane 40 of the previous figure, which delimits the interposition chamber and the intermediate pressure 201 transferring the pressure received by the mobile element 4021 'towards the plate 331 and consequently to the shutter 311.

Unlike the first embodiment, the mobile element 4021 'does not work tightly with the housing chamber 102, a role entrusted to the aforementioned membrane 4023, but similarly to the first embodiment this embodiment also implements at least part of the inventive step by introducing suspension/reactivation members of the transmission kinematic chain as a function of the mechanical stress exerted on it by the pressure of the external environment, which suspend the transmission kinematic chain when the mechanical stress is below a predetermined threshold value and they restore the kinematic transmission chain when said mechanical stress is equal to or exceeds said threshold value.

The behavior already described in relation to the shape of FIG. 2 is then replicated, with the two movable wall elements 4022 'and 4021' which have on their opposite faces, coupling seats/stems and a degree of freedom in movement reciprocal such that the distance between the two varies according to the operating conditions between a position of minimum stroke and a position of maximum stroke. The achievement of the minimum stroke condition coincides with the reactivation condition of the transmission kinematic chain between the force exerted by the external environment and the shutter 311 of the pressure reduction valve.

The ring nut 302 already acting as a stationary stop for the preloading element 312, is modified to act as a further base for a second coil spring 313 positioned coaxially to the spring 312, and exerting on the movable wall element 4022' a force contrary to the force of the external environment.

The ring nut 302 has a special stop 3021, annular in shape, operating as a stop and possibly a coupling seat for the base of the spring 313.

The device according to the present invention therefore solves the problems highlighted with respect to the state of the art with a constructively simple, operationally effective and reliable solution from the point of view of safety and wear resistance.

The embodiment of the present invention refers to a preferred configuration which, however, must not be considered limiting with respect to the combinations of features indicated in the various embodiments in the introductory part of the present description. For example, the choice of a rotationally symmetrical configuration of the device is a preferred choice but should not be construed in a limiting form. Also, the use of coil springs as elastic means of preloading and the particular solution of the adjustable stops by screwing to modify the preloading force is a preferred solution but should not be considered limiting.

The invention claimed is:

1. A first stage pressure reducer for two-stage breathing groups, comprising:

a first chamber adapted to receive a high pressure breathable gas, the first chamber being connected to or configured to be connected via an inlet to a source of the high pressure breathable gas;

a second chamber adapted to receive the breathable gas at an intermediate pressure, the second chamber having an outlet for the breathable gas at the intermediate pressure and being configured to be connected to a user of an intermediate pressure breathable gas; and a pressure reducing valve connecting the first chamber to the second chamber and comprising a valve seat with a communication opening between the first and the second chamber and a shutter cooperating with the valve seat and movable from a closed position of a passage opening to an open position of the passage opening and vice versa, wherein the shutter is dynamically connected to a sensing member of a pressure of an external environment outside the first and the second chamber, the sensing member comprising a transmission mechanism configured to transmit a mechanical load applied on the sensing member by the pressure of the external environment outside the shutter, and wherein the transmission mechanism is provided with a suspension/restoration member of a transmission kinematic chain acting based on the mechanical load applied thereon by the pressure of the external environment, the suspension/restoration member causing a suspension of the transmission kinematic chain when the mechanical load is below a predetermined threshold value and restoring the transmission kinematic chain when the mechanical load is equal to or exceeds the predetermined threshold value.

2. The first stage pressure reducer according to claim 1, wherein the transmission mechanism has two elements movable relatively between each other between the sensing member of the mechanical load applied by the external environment pressure and the shutter, the two elements being connected by a joint coupling actuated by a sensor of the mechanical load of the pressure of the external environment and dynamically connecting the two elements together when the mechanical loads exceeds the predetermined threshold value and being idle when the mechanical load is below the predetermined threshold value.

3. The first stage pressure reducer according to claim 2, wherein the two elements are cursors that move between each other between stop positions, one of the stop positions providing maximum mutual spacing and another one of the stop positions providing mutual abutment to stops, wherein in the mutual abutment position the two elements rigidly move together to approach each other, elastic means of a calibrated force being provided and interposed between the two elements and opposing a movement in a direction of reciprocal approach of the two elements from a position of maximum distance to the mutual abutment position of the stops, and wherein the two elements reach the mutual abutment of a corresponding stop only upon exceeding an opposing force of the elastic means.

4. The first stage pressure reducer according to claim 1, wherein the sensing member of the pressure of the external environment comprises two movable wall elements which are spaced apart from each other with connection means arranged parallel to a sliding direction and are sealingly slidable in a housing chamber, one of the two movable wall elements being an interface with the external environment and another one of the two movable wall elements being an interface between the housing chamber and the second chamber and sealing, respectively, towards the external environment and towards the second chamber an interposition chamber that is isolated from the external environment and from the second chamber, the interposition chamber comprising a segment of the housing chamber and having a variable position and an extension in the sliding direction of the two movable wall elements that is essentially corresponding to a distance between the two movable wall elements, and wherein the connection means between the two movable wall elements introduce at least one degree of freedom between the two movable wall elements with reference to a relative position thereof, the connection means having, a spatially limited free travel state, in which a force of the external environment is not transferred to at least one of the movable wall elements, a state of mutual rigid coupling, in which at least part of the force exerted by the external environment on an external one of the movable wall elements is transferred to another one of the movable wall elements interfacing with the intermediate pressure chamber only when the external environment applies a force exceeding a predetermined level of force, and at least one or a combination of elastic pre-loaded members acting on the external one of the movable wall elements and applying an action in contrast with the force that the external environment applies on the external one of the movable wall elements.

5. The first stage pressure reducer according to claim 4, wherein the at least one or the combination of elastic pre-loaded members comprises a mechanical member.

6. The first stage pressure reducer according to claim 4, further comprising an elastic pre-loading element associated with one of the movable wall elements interfacing with the intermediate pressure chamber, the elastic preloading element being positioned inside the interposition chamber.

7. The first stage pressure reducer according to claim 6, further comprising a stationary abutment, located inside the housing chamber and interposed between the two movable wall elements, the stationary abutment being configured as an adjustable ring nut and being provided with a surface operating as a stop for the elastic preloading element.

8. The first stage pressure reducer according to claim 4, wherein an axis of the passage opening of the valve seat is coincident or parallel to an axis of a chamber housing the sensing member, wherein the shutter comprises a sealing element mounted on a piston sliding in a guide seat, and wherein the valve seat, or a sliding direction of the shutter, are parallel or coincident with the axis of the passage opening of the valve seat and/or with the axis of the chamber housing the two movable walls elements.

9. The first stage pressure reducer according to claim 8, wherein the first chamber, the second chamber, the housing chamber, the valve seat and/or the passage opening in the valve seat, the shutter, the guide seat of the piston, and the movable wall elements have rotational symmetry and are coaxial with each other.

10. The first stage pressure reducer according to claim 4, further comprising a preloading elastic element associated to the shutter.

11. The first stage pressure reducer according to claim 4, wherein, in the interposition chamber, an air pressure is set to a predetermined value and is substantially invariable with respect to conditions of pressure of the external environment and of the first and the second chamber.

12. The first stage pressure reducer according to claim 4, wherein one or more elements forming the housing chamber and/or the sensing member of the pressure of the external environment pressure are made of a material or a combination of materials having thermal conductivity lower than a thermal conductivity of metallic materials, and wherein the material or the combination of materials have mechanical properties that do not compromise a correct functioning of the first stage pressure reducer.

13. The first stage pressure reducer according to claim 4, wherein the sensing member of the pressure of the external environment pressure and the housing chamber are of a cylinder/plunger type, the sensing member comprising at least one rigid element, wherein the transmission mechanism connects one of the movable wall elements interfacing the second chamber with the shutter, and wherein the two movable wall elements have variable spacing elements between a minimum and a maximum distance position.

14. The first stage pressure reducer according to claim 13, wherein each of the movable walls is configured as a piston housed in the housing chamber, which operates as a cylinder, both pistons being sealingly guided along walls of the cylinders via peripheral seals.

15. The first stage pressure reducer according to claim 14, wherein both of the movable wall elements are movable inside the cylinder parallel to one another and in a direction of an axis of the cylinder, the axis of the cylinder being at least parallel or coaxial to a direction of movement of the shutter between the open and closed positions of the passage opening of the valve seat, the transmission members comprising a connecting rod of the sensing member to the shutter.

16. The first stage pressure reducer according to claim 4, wherein a flexible membrane is disposed between the one of the movable wall elements forming the interface with the external environment and the external environment and mounted sealingly to an end of a cylindrical chamber housing the one of the movable wall elements.

17. The first stage pressure reducer according to claim 16, wherein the one of the movable wall elements forming the interface to the external environment is free of sliding sealing gaskets cooperating with a lateral wall that houses the one of the movable wall elements and is free to slide guided along the lateral wall substantially without friction interference.

18. The first stage pressure reducer according to claim 4, wherein one of the movable wall elements forming the interface to the second chamber and the second chamber comprises a flexible compensation membrane sealingly mounted at an end of a cylindrical chamber housing the one of the movable wall elements forming the interface to the second chamber, the flexible compensation membrane acting on the transmission mechanism of the mechanical load applied by the external environment external on the shutter.

19. The first stage pressure reducer according to claim 18, wherein the one of the movable wall element forming the interface to the second chamber is free of sliding sealing gaskets cooperating with a lateral wall that houses the one of the movable wall element forming the interface to the second chamber and is free to slide guided along the latera; wall substantially without friction interference.

* * * * *